US005899484A

United States Patent [19]

Paradis

[11] Patent Number: 5,899,484

[45] Date of Patent: May 4, 1999

[54] TOE PIECE FOR ALPINE SKI SAFETY BINDING

[75] Inventor: Frédéric Paradis, Annecy, France

[73] Assignee: Look Fixations S.A., Nevers, France

[21] Appl. No.: 08/702,636

[22] PCT Filed: Mar. 20, 1995

[86] PCT No.: PCT/FR95/00338

§ 371 Date: Sep. 24, 1996

§ 102(e) Date: Sep. 24, 1996

[87] PCT Pub. No.: WO95/25567

PCT Pub. Date: Sep. 28, 1995

[30] Foreign Application Priority Data

Mar. 24, 1994 [FR] France ..... 94 03715

[51] Int. Cl.[6] ..... A63C 9/085

[52] U.S. Cl. ..... 280/625; 280/629; 280/634

[58] Field of Search ..... 280/624, 625, 280/626, 628, 629, 634

[56] References Cited

U.S. PATENT DOCUMENTS

| | | | |
|---|---|---|---|
| 4,735,434 | 4/1988 | Sedlmair | 280/625 |
| 4,779,891 | 10/1988 | Freisinger et al. | 280/625 |
| 4,889,359 | 12/1989 | Kowatsch et al. | 280/629 |
| 4,938,497 | 7/1990 | Goud | 280/625 |
| 5,050,902 | 9/1991 | Bougue et al. | 280/629 |
| 5,121,939 | 6/1992 | Peyre | 280/629 X |

FOREIGN PATENT DOCUMENTS

| | | |
|---|---|---|
| 335 892 | 4/1977 | Austria . |
| 2075483 | 10/1971 | France . |
| 2 610 841 | 8/1988 | France . |

*Primary Examiner*—Lanna Mai
*Assistant Examiner*—Michael Mar
*Attorney, Agent, or Firm*—Oliff & Berridge PLC

[57] ABSTRACT

A toe piece for a ski safety binding includes a jaw having two lateral arms. The lateral arms pivot about a pin. The return and holding forces during the elastic travel are proportional to the triggering threshold. The useful elastic travel is independent of the triggering threshold. A lateral arm of a jaw exerts a moment on a lever which pivots. The lever is connected at one end to a spring. The triggering threshold is adjusted by altering the ratio of the distances between, on the one hand, the pivot of the lever and the point of contact between the spring and the lever and, on the other hand, the pivot of the lever and the point of contact between the jaw and the lever. The jaw acts on the lever through a movable part which is moved to adjust the triggering threshold.

16 Claims, 7 Drawing Sheets

TOE PIECE FOR ALPINE SKI SAFETY BINDING

The invention relates to a toe piece for an alpine ski safety binding. On a ski, the purpose of such a toe piece is to hold the front end of a ski boot in place, while allowing this end to be released when the force exerted on the toe piece exceeds a predetermined value. This predetermined value is referred to as the triggering threshold. It is chosen in such a way that the force holding the boot is less than the force needed to break the bones or tear the ligaments of the skier wearing the ski.

The lateral force holding the boot is the force, perpendicular to the axis of the boot, exerted at the extreme front end of the boot and corresponding to the moment which the skier must exert in order to pivot it about an axis lying in proximity to his tibia.

On known ski binding toe pieces, the boot of the skier is held in a jaw having two lateral arms. Each lateral arm pivots about a vertical pin. It is returned into its neutral position by a spring. The boot can be released from the binding when the jaw pivots to a given angle about the pin, corresponding to a given elastic travel. The elastic travel is the distance covered by the front end of the boot before being released. A return force exerted by the spring corresponds to each angular position. This force is equal to the spring constant multiplied by the total compression or extension of the said spring.

During the lateral travel, the force holding the boot depends on the following five factors:

- the increasing force of the spring or springs;
- the decreasing lever arm of the lateral arm acting on one of the two rounded edges of the front of the boot, about the pivot axis (the tibia);
- an increasing component of the longitudinal thrust of the heel piece, which presses the boot against the toe piece, reducing the holding force;
- the particular internal mechanism of the toe piece;
- increasing friction.

In general, the result is that the force holding the boot increases starting from the neutral position, reaching a maximum or triggering threshold after a part of the total travel. This part varies depending on the setting of the threshold.

The elastic travel is in fact composed of a first, useful part, in which the return force of the spring can actually overcome the frictional forces plus a component of the longitudinal thrust of the heel piece, and returns the boot to the neutral position, and of a second part, in which the resultant of these forces combined with the decreasing lever arm acting on the rounded tip of the front of the boot about the tibia no longer returns the boot, which therefore remains locked in an off-centred position, if no additional external force is exerted, either to release it or to recentre it.

The possibility of adjusting the triggering threshold on ski binding toe pieces is known. This threshold is not actually the same for all skiers. It varies depending on the skier's height and weight, as well as his proficiency.

It is possible to adjust the triggering threshold by varying the return force exerted by the spring. The solution adopted is generally that consisting in compressing or stretching the return spring to a varying degree when the jaw is in its neutral position. The more the spring is then compressed or stretched in this neutral position, the higher is the triggering threshold.

With such bindings, the force for returning the jaw to its neutral position, for positions before the release position is reached, depends on the setting of the triggering threshold. When the triggering threshold is set close to the minimum, the return spring is not greatly compressed in the neutral position. Because of this, close to this position, the holding force is small compared with the force of the triggering threshold. This force ratio is referred to by the term boot holding, and the result of this low degree of holding is a feeling of lack of firmness for the skier at the start of the elastic travel.

When the triggering threshold is set to an intermediate or maximum value, the return spring is prestressed to a much greater degree when the jaw is in the neutral position, and the holding-force close to this position is nearer to the force of the triggering threshold.

With such bindings it is also observed that, when the triggering threshold is set close to the minimum, the component of the axial force produced by the heel piece and the friction generated are proportionately large. Because of this, the first, useful part of the elastic travel, which ensures return to the neutral position, as described above, is very small, and the second part, in which the boot remains locked in an off-centred position, is greatly increased, in comparison with a threshold setting closer to the maximum.

The holding force is preferably constant from the neutral position to the position at which the boot is released from the binding. A constant force has two advantages.

Firstly, it gives the skier better boot holding.

Secondly, the energy absorbed by the spring is a maximum for a given triggering threshold setting.

The object of the invention is to propose a toe piece for a ski safety binding including a jaw having two lateral arms, pivoting about at least one pin, such that the return and holding forces during the elastic travel are proportional to the triggering threshold, the useful elastic travel then being independent of this threshold.

To this end, the binder toe piece which the invention proposes is a toe piece for an alpine ski safety binding, including a body, a jaw including two lateral arms, which is mounted so as to pivot about one essentially vertical pin, and a lever which is mounted so as to pivot about a transverse pin fixed to the body and on which the jaw, or one jaw arm, exerts a moment by pivoting about its pin, characterized in that the lever is connected to the end of at least one spring, the other end of which is articulated to a fixed point on the binding body, the triggering threshold being adjusted by altering the ratio of the distances between, on the one hand, the pin of the lever and the point of application of the return force of the spring onto the lever, and, on the other hand, the pin of the lever and the point of application of the force exerted by the jaw onto the lever, by acting on a movable part.

When a ski boot fitted to the binding exerts an action on a lateral arm of the jaw, a moment is exerted on the lever. This moment is then opposed by a resisting moment exerted by the spring. By altering the distance between the pin of the lever and the point of application onto the lever of the return force by the spring, the resisting moment opposing the rotation of the lever is changed. The moment exerted by the jaw on the lever, and therefore also the force exerted on the jaw, necessary to release the boot from the binding, vary. The triggering threshold is therefore altered. Equivalently, this triggering threshold is altered by varying the distance between the pin of the lever and the point of application onto the lever of the force exerted by the jaw. Thus, without having to alter the prestress of the spring when the jaw is in the neutral position, it is possible to alter the triggering threshold.

A first variant is characterized in that the lever is mounted vertically in the longitudinal direction of the ski and pivots about a transverse pin passing through the lever, in that the jaw or each lateral arm of the jaw acts on the lever, via a connecting part, at a point of application located on one side of the transverse pin, in that at least one spring is articulated by its ends, on the one hand onto the binding body and, on the other hand, onto a tapped part which is mounted so as to slide on the lever on the other side of the transverse pin and can slide perpendicularly to the transverse pin, and in that a screw, mounted on the lever and engaged in the sliding part, moves the latter by rotating.

A second variant is characterized in that the lever is mounted vertically in the longitudinal direction of the ski and pivots about a transverse pin passing through the lever, in that the jaw or each lateral arm of the jaw acts on the lever, via a connecting part, at a point of application located on one side of the transverse pin, and in that at least one leaf spring is articulated by its ends, on the one hand onto the binding body and, on the other hand, onto a movable part which, movable perpendicularly to the transverse pin, is provided with a rack interacting with a rack fixed to the lever, locking means being provided for holding the movable part in position with respect to the lever.

In this case, the spring is a leaf spring which tends to buckle when it is stressed. In order to cause such a spring to buckle, it is necessary to exert a force of magnitude greater than a critical value (Euler force) Once this threshold has been exceeded, the blade behaves substantially as a conventional spring of relatively low stiffness but greatly prestressed.

It is thus necessary for the lateral arm of the jaw to exert on the spring, via the lever, a force greater than or equal to the critical force, in order to pivot about its pin. Once the critical force has been reached, since the stiffness of the leaf spring is relatively low, the return force of the spring does not increase greatly, but the lever arm of the spring with respect to the pin of the lever increases sufficiently to overcome the factors which tend to reduce the force holding the boot during the elastic travel, in particular the increasing component of the axial force of the heel piece and the reduction in the lever arm of the lateral arm acting on the boot.

In this second variant, the locking means which hold the movable part in position with respect to the lever may include, for example, a wedge which is fixed to a removable flap mounted on the body and optionally forming a window, and interacts with a lug, fixed to the lever or with at least one lateral arm, or alternatively these locking means may include a tongue which is fixed to the movable part and has at least one tooth which interacts with a second rack fixed to the lever.

The springs used in these variants are preferably leaf springs made of composite material with fibres predominantly unidirectional in the longitudinal direction, optionally with fibres crossed at approximately 90° close to the neutral axis.

The shape of these leaf springs is suitable for this application if they have constant thickness except at the ends, where they are rounded, forming a circle arc whose centre is offset with respect to the neutral axis of the leaf, and in that these leaves are wider at the centre than at the ends, so that in maximum flexion, each leaf is deformed along a circle arc, that is to say has a constant radius of curvature. The edges which are rounded in off-centered fashion promote buckling in the chosen direction.

These leaves may be stacked in parallel in order to increase their force. It is also possible to provide a damper device substantially parallel to the spring(s), so that the force opposing the displacement of the jaw, and therefore the triggering threshold, depend on the rate of the said displacement of the jaw.

Another variant of this ski binding is characterized in that the lever includes two parallel plane L-shaped plates which are placed vertically in the longitudinal direction of the ski and are spaced apart, and a plane plate which connects two branches of the two L-shaped plates and is perpendicular to them, in that the lever pivots about a transverse pin which passes through the connected ends of the L-shaped plates, in that the spring is a coil spring, articulated at one of its ends to a fixed point of the binding body and by its other end to the ends of the unconnected branches of the L-shaped plates, in that a sliding part, which can move towards or away from the pin about which the lever pivots, is guided on the plane plate connecting the two L-shaped plates, and in that the jaw, or each arm of the jaw, acts on the lever via a connecting bar which is articulated, on the one hand, onto the jaw, or one arm of the jaw and, on the other hand, onto the sliding part.

When the sliding piece placed between the jaw and the lever is displaced, the position of the point of application of the force exerted by the jaw onto the lever is changed, whereas the position of the point of application of the return force of the spring remains unchanged. The value of the triggering threshold is thus adjusted.

This sliding piece may be displaced using various devices. For example, use may be made of a device in which the position of the sliding piece on the plane plate connecting the two L-shaped plates is set using cables which connect the sliding piece to a nut which can be displaced by virtue of a screw mounted on the binding body, these cables being guided by pulleys, the axis of one of these pulleys coinciding with the pin of the lever. In another example, the sliding piece is tapped, and a rod having a screw thread at one end and equipped with teeth at its other end is, on the one hand, engaged in the sliding part and, on the other hand, rotated by means of its teeth using a rack.

A fourth variant, fairly similar to the preceding one, is characterized in that the lever includes two parallel plane plates which are connected together, are placed vertically in the longitudinal direction of the ski and are spaced apart, in that the lever pivots about a transverse pin passing through the two parallel plane plates of the lever in proximity to their centre, in that a sliding part, which can move towards or away from the pin about which the lever pivots, is guided between the two plane plates and is connected to the jaw, or to each arm of the jaw, via a connecting part, in that the spring, one end of which is articulated to a fixed point of the binding body, is a coil spring whose other end is articulated to one end of each plane plate of the lever, in that a rotatable lever, which has one arm in contact with a screw mounted in the first lever and which abuts against the sliding part via another arm, so as to make the latter slide on the edges of the plane plates, is mounted at the other end of the lever, between the plane plates, on a pin.

In the last two variants, in which the spring is a coil spring, it is preferable for it to be fitted over or into a tube, in order to guide the springs properly, this spring being otherwise held only by its two ends.

Advantageously, the tube and the articulated connection onto the body of the binding form a single piece. It is also possible to provide a damper device with a substantially cylindrical dash pot assembly which, on the one hand, would stabilize the spring or springs and, on the other hand, would provide damping in which the force adjustment would be automatically aligned with the elastic force adjustment, and therefore the triggering threshold adjustment, without any additional device. This damper device may include a fluid damper mounted in parallel with the spring, between a fixed point of the binding body and the lever.

If the spring mounted between the binding body and the lever is a coil spring, it is fitted over the fluid shock-absorber, which serves as a guide for it.

When the jaw has two pins about which the lateral arms pivot, they preferably converge slightly towards one another upwards, giving a slightly upwards diagonal trajectory of the lateral arms. Thus, in the event of falling backwards combined with twisting about the skier's leg, the vertical force component exerted upwards on the jaw creates a rotational moment with respect to the articulation pin of the lateral arm, reducing the lateral force required for triggering the binding.

It is also advantageous to incline the vertical holding plane of the lateral arms in order to further increase the said rotational moment created by an upwards vertical force, in order to make it possible to release the boot under the effect of a purely vertical force associated with falling backwards without twisting.

In order to make it possible for the boot to return better into the axis of the ski, a non-stick plate, for example made of polytetrafluoroethylene, is fixed onto the binding of the ski, in front of the jaw, at the location where the boot held in the binding rests.

In a preferred embodiment, the toe piece according to the invention includes a second lever mounted so as to pivot about a pin substantially parallel to the transverse pin of the first lever, a first end of this lever being intended to be placed under the front end of a skier's boot, and the second end of this lever being intended to be housed in a notch made in the first lever.

Thus, in the event of falling forward combined with twisting about a skier's tibia, the second lever creates a moment on the first lever which tends to release the boot placed in the toe piece, in order to compensate for the frictional forces due to the falling forwards, which occur and which oppose release of the skier's boot.

In any case, the invention will be clearly understood with the aid of the following description, with reference to the appended schematic drawing which represents embodiments of this ski binding toe piece by way of nonlimiting example.

FIG. 1 is a view in longitudinal section thereof along the side I—I in FIG. 2.

Figure 1:
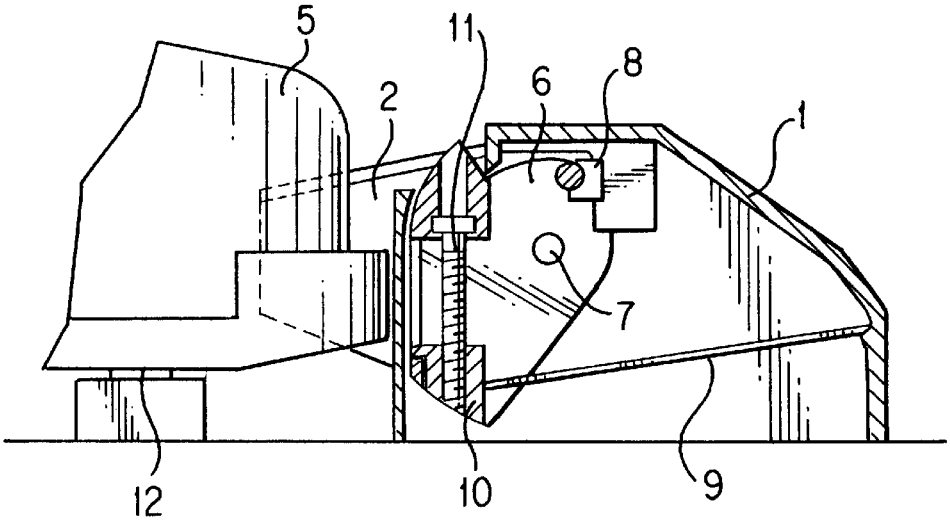
FIGS. 1 to 4 represent a first embodiment of this toe piece.
Figure 2:
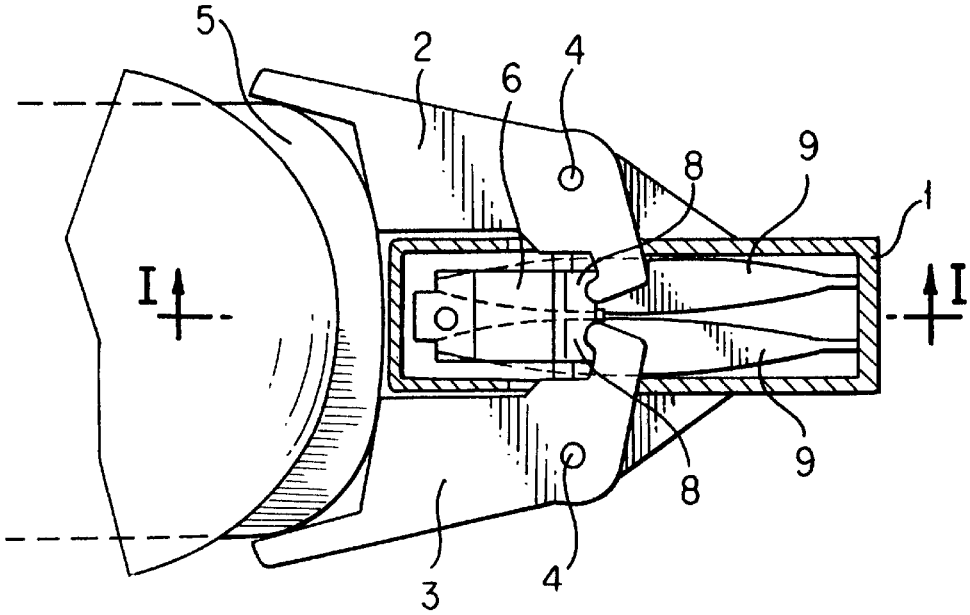
Figure 3:
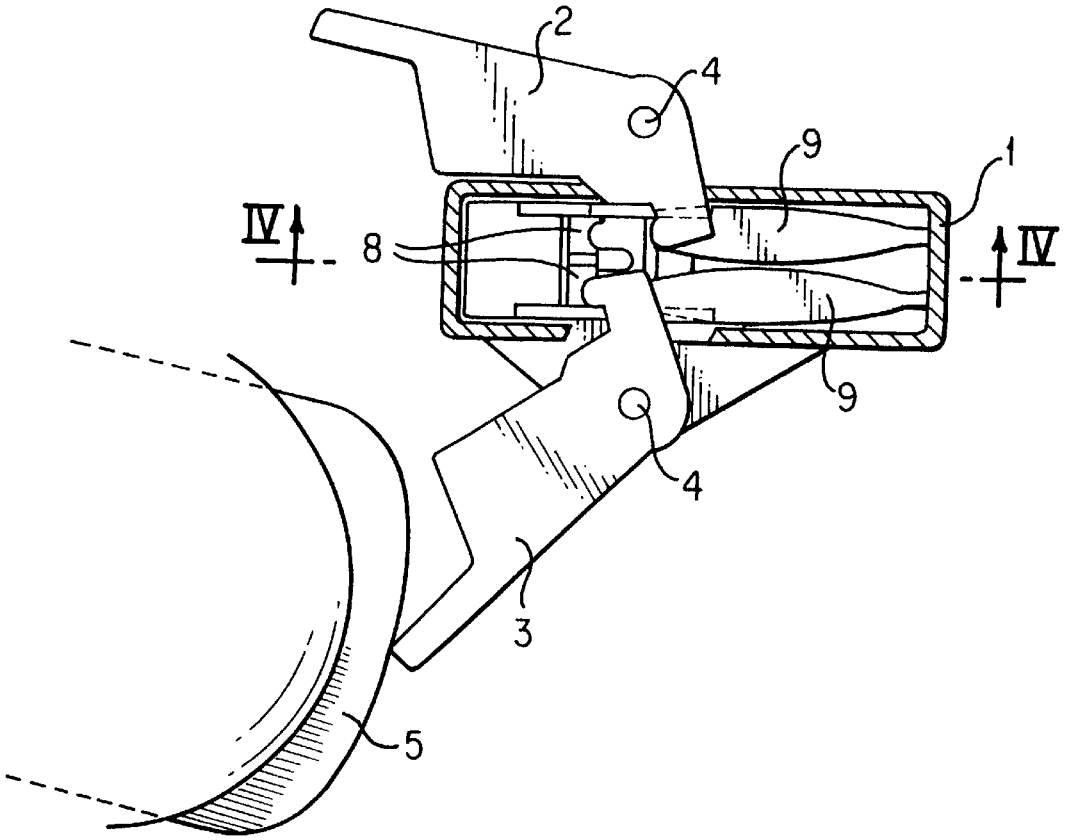
Figure 4:
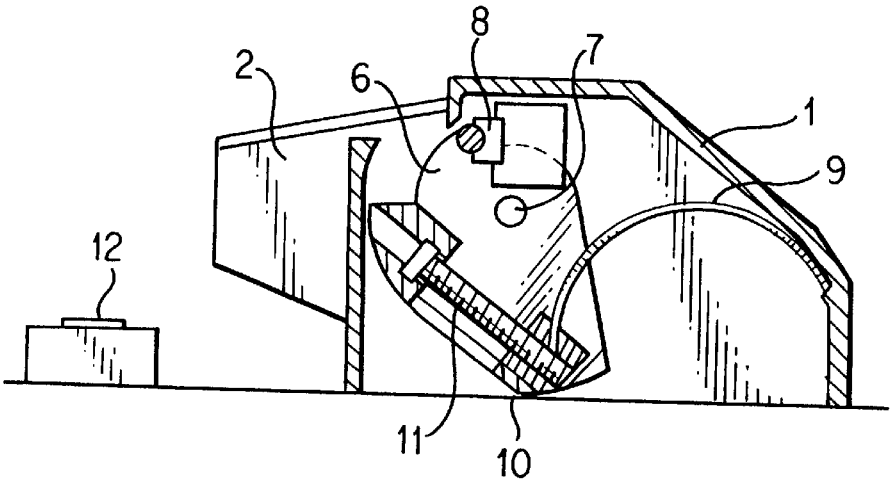
Figure 5:
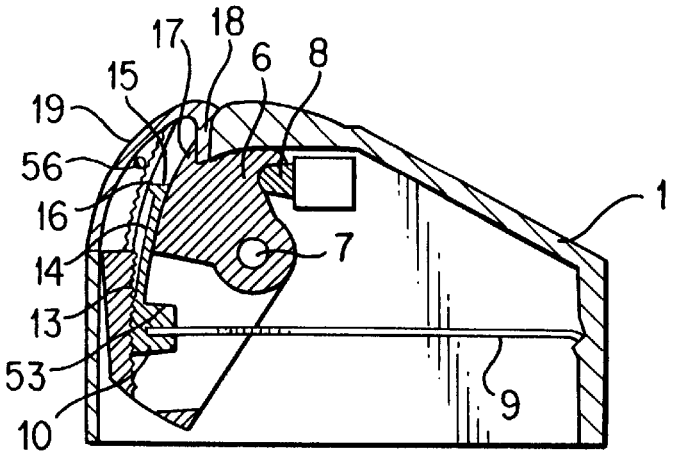
Figure 6:
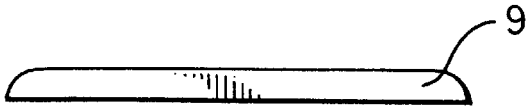
Figure 7:
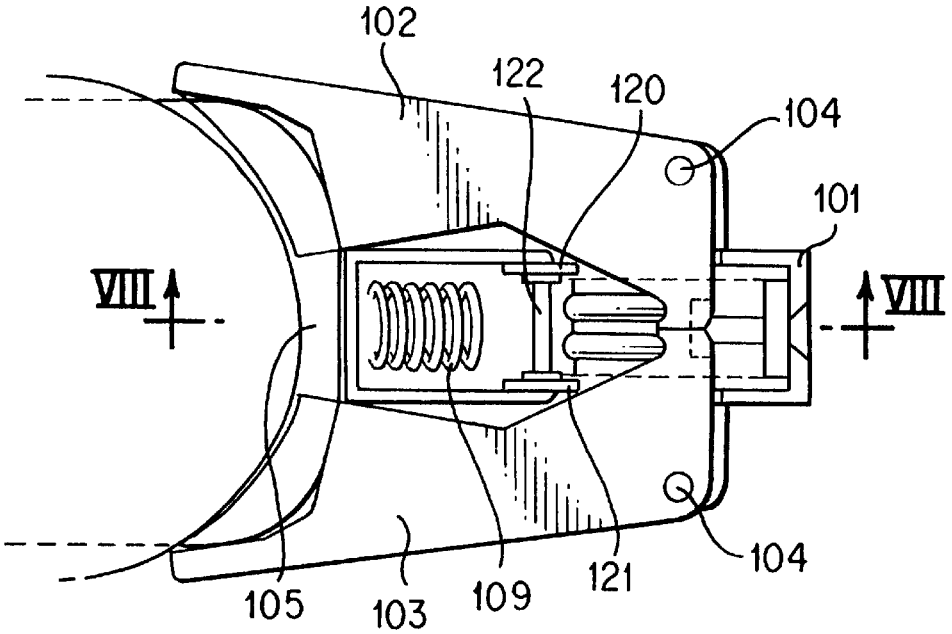
Figure 8:
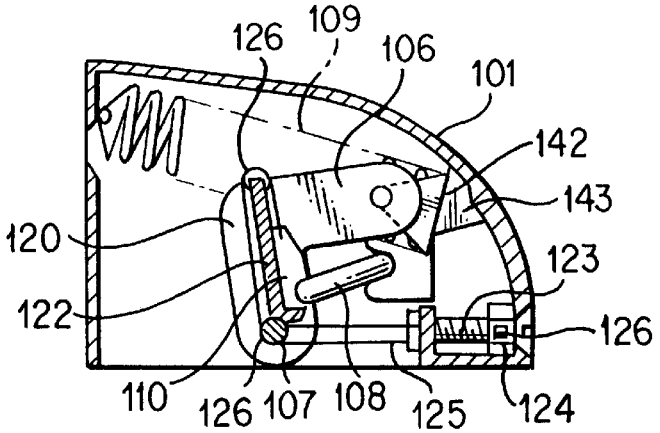
Figure 9:
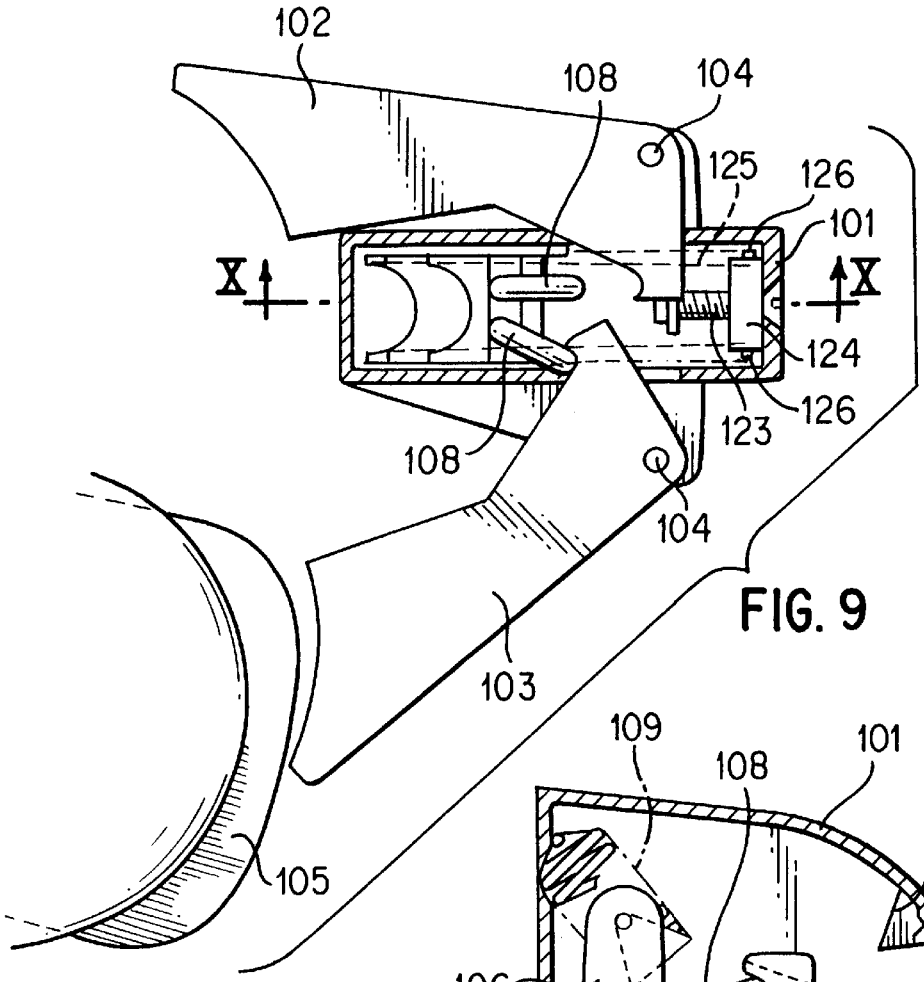
Figure 10:
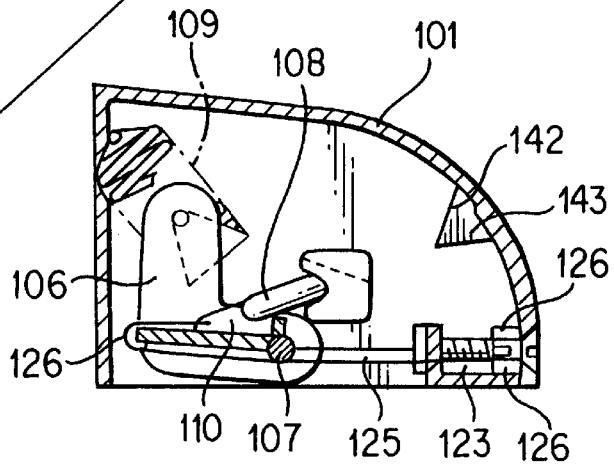
Figure 11:
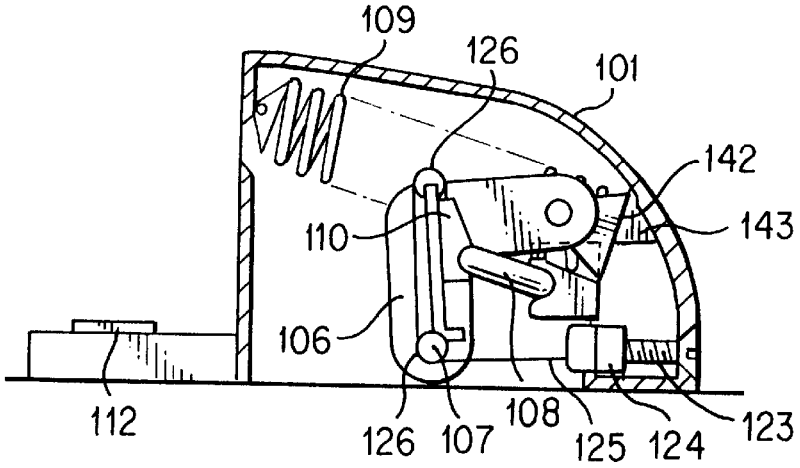
Figure 12:
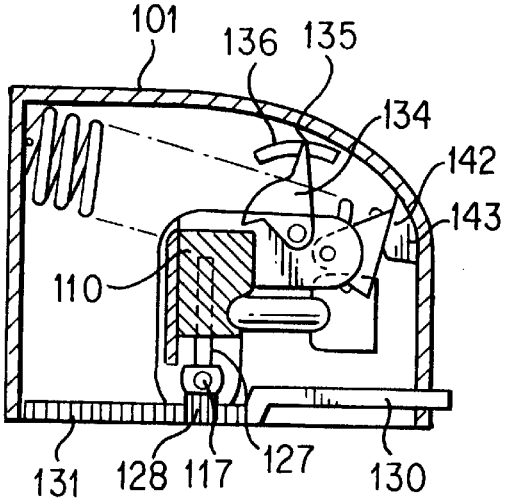
Figure 13:
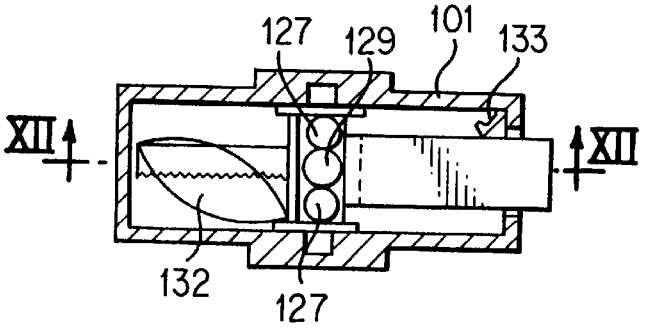
Figure 14:
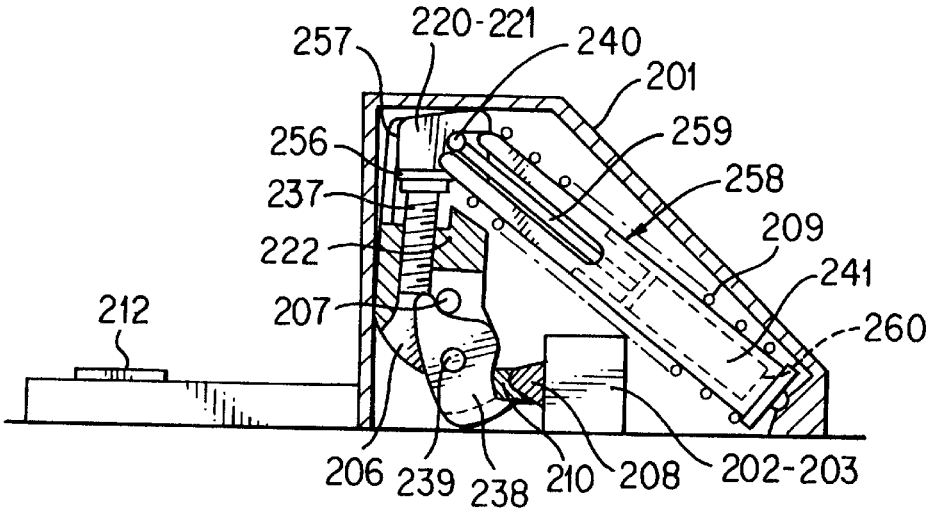
Figure 15:
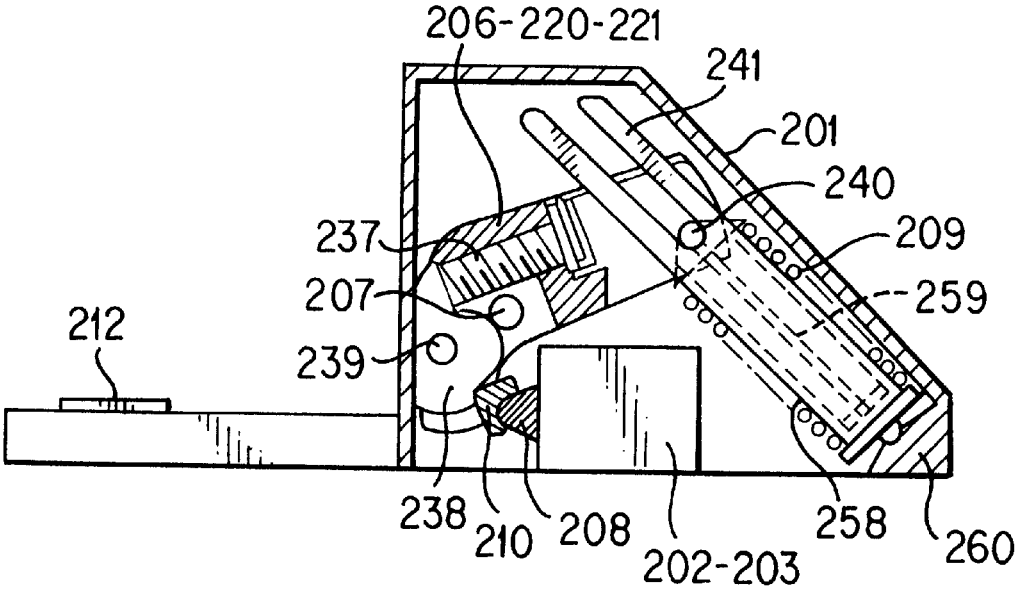
Figure 16:
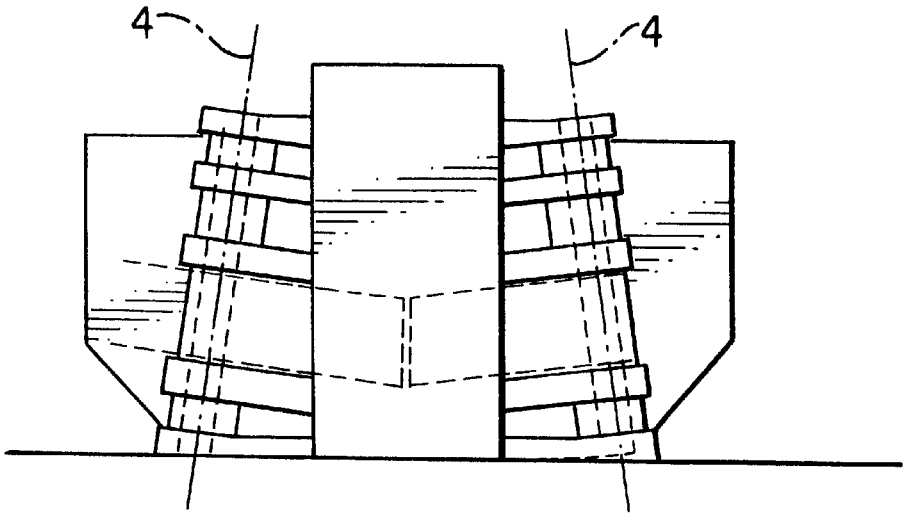
Figure 17:
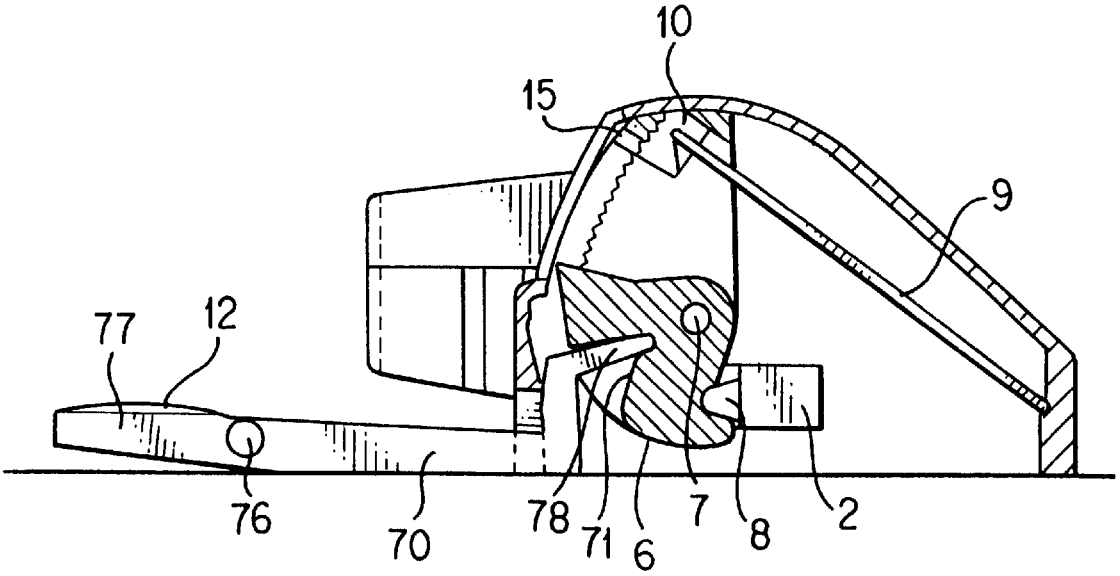
Figure 18:
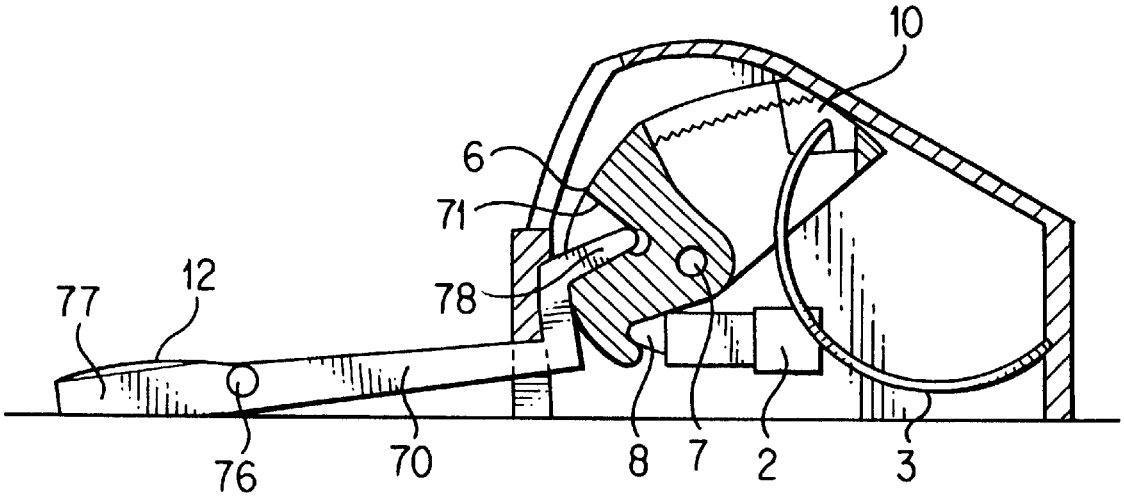

FIG. 2 is a plan view, the jaw of the ski binding being in the neutral position, FIG. 3 is a plan view, the jaw being in the release position, FIG. 4 is a view in longitudinal section of the toe piece, along the line IV—IV in FIG. 3, FIG. 5 is a view in longitudinal section of a second embodiment of this toe piece, FIG. 6 is a side view of the spring used in the two preceding embodiments, FIGS. 7 to 11 represent a third embodiment of this toe piece, FIG. 7 is a plan view, the jaw being in the neutral position, FIG. 8 is a view in longitudinal section, along the line VIII—VIII in FIG. 7, the triggering threshold being set to the maximum, FIG. 9 is a plan view of this toe piece, the jaw being in the release position, FIG. 10 is a view in longitudinal section of this toe piece, the line X—X in Figure IX, FIG. 11 is a view in longitudinal section of this toe piece, along the line VIII—VIII in FIG. 7, the triggering threshold being set to the minimum, FIG. 12 is a view in longitudinal section, along the line XII—XII, in FIG. 13, of a fourth embodiment of this toe piece, FIG. 13 is a plan view of this fourth embodiment of the toe piece according to the invention, FIG. 14 and FIG. 15 represent a fifth embodiment of this toe piece, in longitudinal section, the jaw being respectively in the neutral position and in the release position, FIG. 16 is a front view of a ski binding toe piece according to the invention, FIG. 17 and FIG. 18 represent a sixth embodiment of this toe piece, in longitudinal section, the jaw being respectively in the neutral position and in the release position.

FIGS. 1 to 4 represent a first embodiment of a ski binding according to the invention. A binding body 1 serves as a support for two lateral arms 2, 3, each mounted so as to pivot about a vertical pin 4 and forming a jaw. By means of the jaw 2, 3, the binding has the role of holding the front end of a ski boot 5 in the longitudinal axis of the ski, and also of allowing the boot 5 to be released when a force, corresponding to a moment substantially about the tibia, exceeding a predetermined limit referred to as the triggering threshold, is reached or exceeded. When a sufficient force is exerted on the jaw 2,3 by the boot 5, one lateral arm 2 or 3 of the jaw pivots about its vertical pin 4, leaving its neutral position (FIGS. 1 and 2) to take up its release position (FIGS. 3 and 4).

When a force is exerted on a lateral arm, this force is transmitted to a lever 6 which can move about a transverse pin 7, by means of a connecting piece 8. This force creates, with respect to the pin 7, a moment which opposes a resisting moment generated by the action of two springs 9.

One end of each of these springs is articulated in a suitable cavity of the inner wall of the binding body of the ski. The other end is articulated onto a movable piece 10 whose position can be adjusted. This piece is mounted so as to slide on the lever 6, with the aid of a slideway connection, and is tapped. A screw 11, which can be rotated but cannot translate with respect to the lever 6, engages with the movable piece 10. When the jaw 2,3 is in the neutral position, the screw 11 is substantially vertical. The movable piece 10 can therefore move upwards or downwards, taking with it the end of the springs 9. It is thus possible to vary the resisting moment exerted by the springs 9 on the lever 6, and therefore the triggering threshold.

The moving piece 10 also serves as a cursor and has an index 54 which indicates the chosen triggering threshold setting on a scale on the lever 6, through a hole 55 in the lever and a window on the rear wall of the body 1 of the binding.

These springs are leaf springs. FIG. 2 shows these springs in plan view: they are wider at the centre than at the ends. FIG. 6 shows them in side view: they are of constant thickness, except at the ends which are rounded in off-centred fashion with respect to the neutral fibre, in this case in a quarter circle of radius substantially equal to the thickness of the leaf. These springs are made of composite material with fibres predominantly unidirectional in the longitudinal direction and fibres crossed at 90° close to the neutral axis. The two leaves are mounted side by side and are wider at the centre. These blades could optionally be fixed together and connected at their centre to form a single piece.

Since the springs 9 are leaf springs compressed in the longitudinal direction, deformation of these leaves, and therefore consequently rotation of the lever 6 about the pin 7, occurs only when the force exerted on the ends exceeds a value, referred to as the Euler critical force, above which the said leaf 9 buckles. The leaf spring then curves and behaves substantially as a conventional spring having a relatively low thickness and a large prestress.

In order to limit friction, a non-stick plate 12 is placed under the ski boot 5.

A variant of this toe piece is represented in FIG. 5. The method of setting the triggering threshold and displaying it are different here. Furthermore, the two connecting pieces 8 are connected together and now form only a single connecting piece 8. The movable piece 10 with adjustable position is no longer tapped but is provided with a rack 53, interacting with a first rack 13 connected to the lever 6. A tongue 14, provided with a tooth 15, is fixed to this movable piece 10. This tooth interacts with a second rack 16, also connected to the lever 6.

In this variant, when a boot is fitted in the binding, the separation of the lateral arms 2, 3 induces an opposite force in the springs 9, which push and lock the rack 53 of the movable part 10 with respect to the rack 13 connected to the lever 6. When the boot is removed from the binding, two locking means are provided in order to prevent the said racks from disengaging and to prevent the setting from being altered:

The first means includes a wedge 18, associated with a window 19, which prevents rotation of the lever 6 in the clockwise sense and is placed directly between the body 1 and the lug 17 on the lever 16. This wedge 18 could also be located between the body 1 and a lateral arm 2 (or 3).

Thus, setting the triggering threshold requires, with the boot being removed from the binding, withdrawal of the wedge 19 and the window 19, for example by pivoting the assembly about an articulation onto the body 1. It is then possible to pivot the lever 6 in the clockwise sense. This movement releases the rack 53 of the movable piece 10 with adjustable position. With the aid of the tongue 14, it is possible to slide the movable piece 10 with adjustable position into the desired position, corresponding to the desired triggering threshold. The position of the lever 6 is finally locked in the clockwise direction, by returning the wedge 18 and the window 19 to their initial position, locking the selected setting.

The second locking means still includes the tooth 15, which interacts with a second rack 16 also connected to the lever 6. As before, changing the setting requires the main rack 13 to be disengaged from that of the movable piece 10 by pivoting the lever 6 in the clockwise sense, while pushing in order to disengage the tooth 15 of the second rack 16, and slide the movable piece 10 into the desired position.

Advantageously, a small spring integrated with the movable piece 10 releases its rack 53 and the rack 13 of the lever 6. In order to facilitate setting when increasing the triggering threshold, a small projection 56 is provided on at least one side of the top of the lever 6, this projection serving as a pivot/stop actuated using a finger or using any other suitable tool, making it possible to push the tongue 14 in the opposition direction to the thrust of the lever 6 required to release the racks.

The window 19 makes the opening in the binding body 1 more leaktight, and makes it possible to view the triggering threshold setting indicated by the tooth 15 at the top of the tongue 14, which is used as an index against the scale on the top of the lever 6.

In the variant represented in FIGS. 17 and 18, the leaf spring 9 is placed above the pin 7, in contrast to the previous two embodiments. The lateral arms 2, 3 are, for their part, placed below this pin 7.

A compensator lever 70, mounted so as to pivot about a pin 76 substantially parallel to the transverse pin 7, is provided in this variant. The non-stick plate 12 is located on one end 77 of this lever 70. The other end 78 of the lever is housed in a notch 71 made in the lever 6.

In the event of falling forward, combined with twisting about the skier's tibia, a vertical force is exerted on the non-stick plate 12 and also on the end 77 of the lever. This additional vertical force is added to a fraction of the skier's weight and the frictional force opposing the lateral movement of the boot is thereby increased in comparison with simple twisting about the skier's tibia. This frictional force opposes the action of the boot on one or other of the lateral arms 2, 3 of the toe piece and therefore the release of this boot.

The lever 70 is intended to compensate for this additional frictional force, that is to say that it makes it possible to promote release of the boot when it presses substantially vertical on the non-stick plate 12. In fact, when pressure is applied on the end 77 of the lever, the other end 78 of the lever acts on the lever 6, against the action of the leaf spring 9. The moment thus created makes it possible to reduce the force which needs to be exerted on one of the lateral arms 2, 3 in order to release the skier's boot.

The ratio of the lever arms about the pin 76 and the shape of the notch 71 made in the lever 6 are chosen such that the moment exerted on the lever 6 by the end 78 of the lever 70 is substantially equal to the loss of moment exerted by a lateral arm 2 or 3 on the lever 6 due to the additional frictional force between the non-stick plate 12 and the skier's boot.

FIG. 18 represents the toe piece according to the variant described above, in its boot release position, at the end of triggering.

In the embodiment represented in FIGS. 7 to 11, the leaf spring 9 is replaced by a coil spring 109. Those pieces in this variant which have the same function as the corresponding pieces in the first two variants have the same references, increased by 100.

This embodiment again contains the binding body 101, serving as a support for two lateral arms 102, 103, which each pivot about a vertical pin 104 and form a jaw which holds the front end of the sole of a boot 105. When the latter exerts a force on the jaw, this force is transmitted to a lever 106 which can move about a horizontal pin 107 by means of a connecting piece 108.

The lever 106 includes two parallel L-shaped plates 120 and 121, which are placed vertically in the longitudinal direction and are spaced apart. When the jaw 102, 103 is in the neutral position, the substantially horizontal branch of the L is higher than the other branch. A substantially plane and vertical third plate 122 connects the two substantially vertical branches of the L-shaped plates 120 and 121 when the jaw is in the neutral position.

The lever 106 pivots about the pin 107 which passes through the L-shaped plates close to the lower end of the vertical branch, when the jaw is in the neutral position.

The end of a cylindrical compression spring 109 is attached in the vicinity of the end of the other branch by means of an articulated connection. The other end of the spring is fixed by means of another articulated connection to a fixed point on the binding body. When the boot is removed from the binding, that end of the spring 109 which is attached to the lever 106 rests on a surface 142 formed for this purpose on the inner face of the binding body 101. This surface constitutes the edge of a rib 143 of the binding body 101.

With the jaw 102 or 103 transmitting the force exerted by the boot 105 onto a lateral arm, the connecting piece 108 bears, on the one hand, in a cavity formed in a lateral arm and, on the other hand, in an articular cavity, on a movable piece 110 whose position is adjustable. This movable piece 110 is guided by a slideway connection on the plate 122 connecting the two L-shaped plates 120 and 121 of the lever 106. In the neutral position, the movable piece 110 can move on a line of greatest slope of the plate 122. Thus, for a given force exerted on the jaw, the force transmitted by the connecting piece 108 onto the lever does not vary, but the moment exerted with respect to the horizontal point 107 varies as a function of the movable piece 110.

The position of the movable piece 110 on the plate 122 is set using a screw 123, a nut 124, cables 125 and pulleys 126. The screw 123 is fixed onto the binding body 101, can rotate and cannot move in translation with respect to this body 101. The nut 124 is engaged on the screw 123 and can move in translation but cannot rotate with respect to the body 101. The cables 125 are attached on each side of the nut 124, on the one hand, and the movable piece 110, on the other hand. They are guided by the pulleys 126. One pulley 126 is located at each end of the horizontal pin 107 about which the lever 106 pivots, as well as in proximity to the front wall of the binding body 101. Thus, when the lever pivots, the position of the movable piece 110 does not vary with respect to the plate 122 without the screw 123 being acted on. The nut 124 also serves as a cursor, indicating the triggering threshold setting on a scale (not shown) fixed on the body 101.

Thus, in FIGS. 7 to 10, the movable piece 110 is down when the jaw is in the neutral position. This corresponds to the maximum triggering threshold. In FIG. 11, the movable piece 110 is up, the triggering threshold being a minimum.

FIGS. 12 and 13 represent a variant of this embodiment. The above general form of the ski binding toe piece is again found. Only the method of setting the position of the movable piece 110 on the plate 122 of the lever 106 and the device making it possible to view the setting are different.

The movable piece 110 is here tapped. It is screwed onto two threaded rods 127, each provided with a toothed wheel 128 at their lower end. A transfer pinion 129 connects the two toothed wheels 128. A lever 130, fitted with a rack 131, interacts with the toothed wheels in order to move the movable piece 110. A spring 132 holds the rack away from the toothed wheels 128. When the lever 138 is pushed so as to pivot it about the bearing point 133, the teeth of the rack 131 mesh with a toothed wheel 128. If the lever 130 then moves longitudinally, that is to say into or out of the binding body, the meshed toothed wheel 128 rotates and, via the transfer pinion 129, moves the other toothed wheel 128. The two threaded rods 127 then rotate in the same sense while taking the mobile piece 110 with them. When the lever 130 is released, once the desired position has been reached, the spring 132 moves the rack 131 away from the toothed wheel 128 and returns the rack 131 into the binding body 101.

A small lever 134, mounted so as to pivot about a horizontal pin, bears on the upper face of the movable piece 110 and, with an index 135, indicates the chosen triggering threshold setting on a scale 136.

Another variant is represented in FIGS. 14 and 15. A lever 206 includes two parallel plane plates 220 and 221, connected to one another by a substantially horizontal plate 22 when the lateral arms 202, 203 forming the jaw are in the neutral position. The two parallel plane plates 220 and 221 are placed vertically in the longitudinal direction of the ski and are pierced by a transverse pin 207, about which they pivot. The plate 222 is tapped and receives a screw 237. The head of the screw 237 is provided with a freely rotatable cursor 256, the index of which indicates the triggering threshold setting on a scale 257 fixed on the lever 206. A sliding piece 210, with adjustable position, is guided on the edges of the vertical plates 220 and 221. It is connected to each arm of the jaw by a connecting piece 208. The movable piece 210 slides so as to move towards or away from the transverse pin 207.

A second lever 238, having two arms, is mounted vertically and so as to pivot about a second transverse pin 239, between the two vertical plates 220 and 221 of the lever 206. One arm of this lever is in contact with the end of the screw 237, and the other with the movable piece 210. Thus, acting on the screw 237 causes the movable piece 210 to slide towards or away from the pin 207, thus making it possible to vary the moment of a given force exerted by the jaw on the lever 206 with respect to the pin 207, and therefore the triggering threshold.

Advantageously, the edges of the two vertical plates 220 and 221 on which the mobile piece 210 slides are inclined with respect to the line of contact with the lateral arms 202, 203, making it possible to change the initial compression of the spring 209 at the same time as the length of the lever arm, thus contributing to the alteration of the triggering threshold.

With the second lever 238 being mounted between the plates 220, 221 on one side of the transverse pin 207, a spring 209 is attached at one of its ends, by means of an articulated connecting piece, to a third transverse pin 240, mounted between the plates 220, 221, on the other side of the pin 207. The other end of the spring is fixed by means of an articulated connecting piece to a fixed point on the binding body 201. This spring 209 is fitted over a tube 241, in order to provide better guidance of the spring when it is compressed and extends.

Advantageously, the articulated connection onto the binding body 201 and the tube 241 form a single piece.

In FIGS. 14 and 15, the tube 241 is the outer tube of a fluid damper 258. This damper 258 is mounted in parallel with the spring 209. The end of the rod 259 of the piston of the damper is articulated at the pin 240, and the end wall of the cylinder 260 is articulated to the same fixed point on the binding body 201 as one of the ends of the spring 209.

In all the variants described above, the jaw includes two lateral arms mounted so as to pivot about a pin 4, These pins may be vertical, or alternatively they may converge slightly towards one another, as shown in FIG. 16. The pin ends located towards the ski are then further apart from one another than the other two ends, giving a slightly upwards diagonal trajectory of the lateral arms. Thus, in the event of falling backwards combined with twisting about the skier's leg, the vertical force component exerted upwards on the jaw creates a rotational moment with respect to the articulation pin of the lateral arm, reducing the lateral force required to trigger the binding.

It is also advantageous to incline the vertical holding plane of the lateral arms, in order further to increase the said rotational moment created by an upwards vertical force, in order to make it possible to release the boot under the effect of a vertical force associated with falling backwards without twisting.

Moreover, in all these variants a non-stick plate 12, 112, 212 is placed on the ski boot fitted into the binding.

As is clear, the invention is not limited to the embodiments described above by way of example, but encompasses all variants thereof. Thus, other spring arrangements or other ways of setting the position of the movable piece are, for example, possible.

I claim:

1. Toe piece for an alpine ski safety binding, including a body, a jaw including two lateral arms, each of which is mounted so as to pivot about one of two essentially vertical pins, and a lever which is mounted so as to pivot about a transverse pin fixed to the body and on which at least one of the lateral arms exerts a moment by pivoting about its vertical pin, one end of at least one spring being operatively connected to a movable part that is movably mounted on the lever, the other end of the at least one spring being articulated to a fixed point on the binding body, a triggering threshold, upon which at least one of the lateral arms is movable to a release position, being deterred by the ratio of the distance between the pin of the lever and a point of application of a return force of the spring onto the lever with respect to the distance between the pin of the lever and a point of application of the moment expected by at least one of the lateral arms onto the lever, the ratio being altered by moving the movable part relative to the lever for adjusting the triggering threshold.

2. Toe piece according to claim 1, the lever being mounted vertically in a longitudinal direction of the ski and pivotal about a transverse pin passing through the lever, each lateral arm of the jaw acting on the lever via a connecting part, at a point of application located on one side of the transverse pin, the at least one spring being articulated by its ends, onto the binding body and onto a tapped part which is slidably mounted on the lever on the other side of the transverse pin and can slide perpendicularly to the transverse pin, and a screw mounted on the lever and engaged in the tapped part, the screw adapted to move the tapped part by rotating the screw.

3. Toe piece according to claim 2, the at least one spring being a leaf spring made of composite material with fibres predominantly unidirectional in the longitudinal direction.

4. Toe piece according to claim 3, the leaf spring having a constant thickness except at the ends, where they are rounded, forming a circle arc whose centre is offset with respect to the neutral axis of the leaf spring, and the leaf spring being wider at the centre than at the ends, so that in maximum flexion, the leaf spring is deformed along a circle arc, that is to say has a constant radius of curvature.

5. The toe piece of claim 3, further comprising fibres crossed at approximately 90° close to a neutral axis.

6. Toe piece according to claim 2, the spring being a coil spring which is fitted over a tube.

7. The toe piece of claim 2, the spring being a coil spring which is fitted into a tube.

8. Toe piece according to claim 1, characterized in that the lever is mounted vertically in the longitudinal direction of the ski and pivots about a transverse pin passing through the lever, at least one lateral arm of the jaw acting on the lever, via a connecting part on one side of the transverse pin, the spring being at least one leaf spring which is articulated by its ends onto the binding body and onto the movable part, the immovable part being movable perpendicularly to the transverse pin, and having a rack interacting with a rack fixed to the lever, and locking means for holding the movable part in position with respect to the lever.

9. Toe piece according to claim 8, the locking means including a wedge which is fixed to a removable flap that is mounted on the body and forming a window, and interacts with a lug fixed to at least one of the lever and the at least one lateral arm.

10. Toe piece according to claim 8, the locking means including a tongue which is fixed to the movable part and has at least one tooth which interacts with a second rack fixed to the lever.

11. Toe piece according to claim 1, the lever including two parallel plane L-shaped plates which are placed vertically in the longitudinal direction of the ski and are spaced apart, and a plane plate which connects two branches of the two L-shaped plates and is perpendicular to them, the lever being pivotal about a transverse pin which passes tough the connected ends of the L-shaped plates, the spring being a coil spring, articulated at one of its ends to a fixed point on the binding body and by its other end to the ends of unconnected branches of the L-shaped plates, the movable part movable with respect to the transverse pin about which the lever pivots, is guided on the plane plate connecting the two L-shaped plates, and at least one of the lateral arms of the jaw, acts on the lever via a connecting bar which is articulated onto at least one of the lateral arms of die jaw and onto the movable part.

12. Toe piece according to claim 1, the lever including two parallel plane plates which are connected together are placed vertically in the longitudinal direction, of the ski and are spaced apart, the lever being pivotal about a transverse pin passing through the two parallel plane plates of the lever in proximity to their centre, the movable part movable with respect to the transverse pin about which the lever pivots, is guided between the two plane plates and is connected to at least one of the lateral arms of the jaw via a connecting part, one end of the spring being articulated to a fixed point on the binding body, and being a coil spring whose other end is articulated to one end of each plane plate of the lever, a rotatable lever, which has one arm in contact with a screw that is mounted in the first lever and which abuts against the movable part via another arm, the movable part being sizable on the edges of the plane plates, the screw being mounted at the other end of the lever, between the plane plates, on a pin.

13. Toe piece according to claim 1, the pins, about which the arms of the jaw pivots converging slightly towards one another in an upward direction.

14. Toe piece according to claim 1, further comprising a fluid damper mounted in parallel with the spring, between a fixed point on the binding body and the lever.

15. Toe piece according to claim 14, the spring being a coil spring and fitted over the fluid damper, which serves as a guide for the spring.

16. Toe piece according to claim 1, further comprising a second lever mounted so as to pivot about a pin substantially parallel to the transverse pin of the first lever, a first end of the second lever adapted to be placed under the front end of a skier's boot, and the second end of the second lever adapted to be housed in a notch in the first lever.

* * * * *